US008989430B2

(12) United States Patent
Grenzing et al.

(10) Patent No.: US 8,989,430 B2
(45) Date of Patent: Mar. 24, 2015

(54) FLAT SPEAKER

(75) Inventors: Benjamin Grenzing, Hamburg (DE); Henning Scheel, Hamburg (DE); Frank Cordes, Stade (DE)

(73) Assignee: Airbus Operations GmbH, Hamburg (DE)

( * ) Notice: Subject to any disclaimer, the term of this patent is extended or adjusted under 35 U.S.C. 154(b) by 560 days.

(21) Appl. No.: 12/605,412

(22) Filed: Oct. 26, 2009

(65) Prior Publication Data

US 2010/0119095 A1 May 13, 2010

Related U.S. Application Data

(63) Continuation of application No. PCT/EP2008/055083, filed on Apr. 25, 2008.

(60) Provisional application No. 60/926,350, filed on Apr. 26, 2007.

(30) Foreign Application Priority Data

Jul. 3, 2007 (DE) ..... 10 2007 030 811

(51) Int. Cl.
*H04R 1/00* (2006.01)
*H04R 7/04* (2006.01)
*H04R 9/06* (2006.01)

(52) U.S. Cl.
CPC ..... *H04R 7/045* (2013.01); *H04R 9/066* (2013.01); *H04R 2207/021* (2013.01)
USPC ..... 381/431

(58) Field of Classification Search
USPC ..... 381/431
See application file for complete search history.

(56) References Cited

U.S. PATENT DOCUMENTS

| | | | | |
|---|---|---|---|---|
| 2,123,640 | A * | 7/1938 | Warnke | 381/420 |
| 4,392,027 | A | 7/1983 | Bock | |
| 6,177,887 | B1 * | 1/2001 | Jerome | 725/76 |
| 6,320,967 | B1 | 11/2001 | Azima et al. | |
| 6,574,347 | B1 | 6/2003 | Linse | |
| 6,764,046 | B2 | 7/2004 | Itakura et al. | |
| 2001/0055402 | A1 | 12/2001 | Azima | |

(Continued)

FOREIGN PATENT DOCUMENTS

| | | |
|---|---|---|
| CN | 1269755 | 10/2000 |
| EP | 1100287 | 5/2001 |

(Continued)

OTHER PUBLICATIONS

German Office Action from DE 10 2007 030 811.8 dated Dec. 5, 2007.

(Continued)

*Primary Examiner* — Davetta W Goins
*Assistant Examiner* — Amir Etesam
(74) *Attorney, Agent, or Firm* — Jenkins, Wilson, Taylor & Hunt, P.A.

(57) ABSTRACT

The present invention provides a flat speaker, in particular in the aerospace sector, with a panel for generating acoustic signals by vibration of the same, and a vibration exciter which is connected to a panel and excites this to vibrate. Here the panel has an edge stiffening. This provides the panel with the required stiffness, particularly against hand pressures, but at the same it guarantees high energy efficiency of the flat speaker.

10 Claims, 5 Drawing Sheets

(A-A)

(56) References Cited

U.S. PATENT DOCUMENTS

| | | | | |
|---|---|---|---|---|
| 2002/0094108 | A1 | 7/2002 | Yanagawa et al. | |
| 2005/0036647 | A1 | 2/2005 | Nguyen et al. | |
| 2006/0018504 | A1* | 1/2006 | Kam | 381/431 |
| 2007/0009133 | A1 | 1/2007 | Gerkinsmeyer | |
| 2007/0160233 | A1* | 7/2007 | De Haan | 381/111 |

FOREIGN PATENT DOCUMENTS

| | | | |
|---|---|---|---|
| EP | 1398992 | A1 | 3/2004 |
| GB | 2341511 | A | 3/2000 |
| JP | 55 140395 | A | 11/1980 |
| JP | 55 140397 | A | 11/1980 |
| JP | 55 140398 | A | 11/1980 |
| JP | 57 002193 | A | 1/1982 |
| JP | 57002193 | | 1/1982 |
| JP | 61-103393 | | 5/1986 |
| JP | 11220786 | | 8/1999 |
| JP | 2000-125390 | | 4/2000 |
| JP | 2002-532993 | | 10/2002 |
| JP | 2003-224896 | | 8/2003 |
| JP | 2005-198342 | | 7/2005 |
| RU | 2246802 | | 2/2005 |
| WO | WO 9709842 | | 3/1997 |
| WO | WO 9831188 | | 7/1998 |
| WO | WO 0035242 | | 6/2000 |
| WO | WO 0223946 | | 3/2002 |
| WO | WO 2008/132170 | | 11/2008 |

OTHER PUBLICATIONS

International Search Report and Written Opinion for PCT/EP2008/055083 dated Jul. 30, 2008.

Japanese Office Action for Serial No. 2010/504710 dated Sep. 11, 2012.

Russian Office Action for Application No. 2009138228/28 dated Mar. 16, 2012.

Russian Decision for Refusal for Application No. 2009138228/28 dated May 14, 2013.

Russian Office Action for Application No. 2009138228/28 dated Jul. 12, 2012.

Chinese Office Action for Application No. 200880013572.6 dated Jul. 2, 2012.

* cited by examiner (A-A)

(B-B)

(B-B)

(B-B)

(C-C)

FLAT SPEAKER

CROSS-REFERENCE TO RELATED APPLICATIONS

This application is a continuation of PCT International Application No. PCT/EP2008/055083 filed Apr. 25, 2008, which claims the benefit of U.S. Provisional Application No. 60/926,350, filed Apr. 26, 2007, and German Patent Application No. 10 2007 030 811.8, filed Jul. 3, 2007, the entire disclosures of which are herein incorporated by reference.

FIELD OF THE INVENTION

The present invention relates to a flat speaker, particularly in the aerospace sector, and an aircraft or space vehicle with at least one such flat speaker.

Although it can be used in any sector, the present invention and its underlying concept are explained in further detail in connection with a passenger aircraft.

In conventional public address systems in aircraft cabins of passenger aircraft for the broadcasting of verbal announcements, use is made of conventional electrodynamic speakers which are installed in an acoustic pipe. Because of the minimum size of the membrane required for the fundamental tone reproduction, conventional speakers have a very high directivity in the medium and high frequency sound range and therefore give rise to highly unequal sound distribution inside the cabin. This and other disadvantages can be eliminated by using flat speakers instead of conventional electrodynamic speakers.

Flat speakers have a vibration exciter which is connected to a panel and excites it to vibrate. The panel is in this case advantageously designed as part of the interior lining of the aircraft cabin. Here the panel must be protected from damage by passengers, particularly by hand pressure.

SUMMARY OF THE INVENTION

The object of this invention is therefore to provide a flat speaker with a mechanically highly loadable panel.

This object is achieved by the disclosure.

Accordingly a flat speaker is provided, particularly in the aerospace sector, with a panel for generating acoustic signals by vibration of the same and with a vibration exciter which is connected to the panel and excites it to vibrate. In this case the panel has edge stiffening which is designed to prevent damage to the panel by passengers, wherein the edge stiffening is designed as at least one layer which is applied to the panel and which has at least one recessed region.

Furthermore, a vehicle is provided, in particular an aircraft or space vehicle, with a cabin region for passengers, pilots and/or co-pilots and at least one flat speaker according to the invention for a public address system for the passengers, pilots and/or co-pilots, the panel of the flat speaker forming a section of the cabin region itself.

The underlying concept of this invention is to provide a stiffening of the panel in its edge region. This measure considerably increases the mechanical stability of the panel, thus preventing damage to the panel by passengers. At the same time the energy efficiency of the flat speaker is only slightly reduced because of the edge stiffening of the panel. Furthermore, radiation of the first panel mode is improved.

Advantageous embodiments and improvements of the invention are described herein.

In this patent application a "panel" refers to an essentially plane component.

Here an "edge stiffening" is understood to mean a stiffening that is also provided only in sections and is arranged in an edge region of the panel, and/or a stiffening that is also only provided in sections and is adjacent to one edge (i.e. a border) of the panel. Obviously the stiffening may also extend over the entire length and/or width of the panel in its edge region and/or adjacent to one edge of the panel.

In particular, the stiffening should be designed as a component that considerably increases the flexural strength of the panel. The stiffening therefore preferably extends in the panel plane and has a cross-section which displays a high moment of superficial inertia compared to the cross-section of the panel in order to resist flexural loads introduced. Alternatively or additionally, the stiffening has a material with a high modulus of elasticity.

According to a preferred development, the panel is designed as a sandwich material with at least one upper covering layer, at least one lower covering layer and a core material arranged between these covering layers. Such sandwich materials have good acoustic radiation properties.

In a further preferred embodiment of the flat speaker according to the invention the edge stiffening is designed as at least one stiffening profile, in particular a U-shaped profile and/or isosceles or non-isosceles angle. Here "profile" is understood to mean a component which extends in one direction, referred to in the following as the longitudinal direction, with an essentially constant cross-section. A stiffening of this type can be produced at low cost.

According to a further preferred development of the flat speaker according to the invention, at least one of the covering layers is bent out of the plane of the panel to form the edge stiffening at its one end. In this embodiment the edge stiffening is therefore designed as part of the panel. The provision of an edge stiffening as a separate part is therefore advantageously dispensed with. The bent out end of the at least one covering layer is preferably essentially perpendicular to the plane of the panel. A moment of superficial inertia of the bent out end can therefore be maximised to resist the flexural loads introduced into the panel.

In a further preferred embodiment of the flat speaker according to the invention the respective ends of the upper and lower covering layer are bent out of the plane in the same direction, overlapping each other in sections. This means that the upper and lower covering layer are either both bent upwards or downwards, for example. Such edge stiffening is simple to produce. The overlapping sections of the upper and lower covering layer are preferably glued to each other, thus producing a very stiff bond.

Obviously it is equally conceivable for the upper and lower covering layer to be bent out of the plane of the panel in opposite directions.

In a further preferred development of the inventive flat speaker, the core material is squeezed against at least one end and against the upper and lower covering layer and bent out of the plane of the panel to form the edge stiffening. Edge stiffening produced in this manner is also described as a "crushed-core edge". It is characterised by high stiffness and is easy to produce.

In this patent application the "upper covering layer" should preferably be turned away from the passenger in the installation position of the flat speaker, and the "lower covering layer" should be arranged facing the passenger. Preferably the upper and lower layer are both bent upwards, i.e. the lower covering layer is bent out towards the upper covering layer and the upper covering layer is bent out away from the lower covering layer. The advantage of this is that the edge stiffening thus produced is not visible to the passenger in the installation position of the flat speaker.

According to a further preferred embodiment of the inventive flat speaker the edge stiffening is designed as at least one layer which is applied to the panel and which has at least one recessed, in particular rectangular region. The layer is in this case an additional layer which is applied to the upper covering layer, for example. This edge stiffening is also characterised in that it is very simple to produce.

According to a further preferred embodiment of the inventive flat speaker, the panel and/or the edge stiffening has a curved shape in at least one plane. Because of this measure a further stiffening of the panel is advantageously achieved.

According to a further preferred development of the inventive flat speaker, the edge stiffening is glued to the panel, in particular laminated onto it and/or laminated into it. Because the edge stiffening and the panel are typically produced from composite fibre materials, such a combination of these materials is particularly advantageous. As already mentioned, the edge stiffening forms part of the panel or can be designed as a separate component. The embodiment whereby the edge stiffening is glued to the panel only makes sense for embodiments in which the edge stiffening is designed as a separate component—and not as part of the panel itself, for example in the case where the edge stiffening is designed as a stiffening profile.

In a further preferred embodiment of the inventive flat speaker the vibration exciter is connected to one of the covering layers and the edge stiffening is applied to the covering layer connected to the vibration exciter. This embodiment is particularly advantageous when the edge stiffening and the vibration exciter are applied to the upper covering layer, as the edge stiffening and the vibration exciter are not then visible to the passenger in the installation position of the flat speaker in the aircraft, for example in the acoustic pipe.

In a further preferred development of the inventive flat speaker the panel has an area ranging between 400 and 800 $cm^2$, preferably approximately 600 $cm^2$. These values were determined experimentally as particularly advantageous in terms of the energy efficiency of the flat speaker.

Further advantages in terms of high energy efficiency of the flat speaker are achieved with a panel thickness of between 4 and 8 mm. Here the thickness relates to a panel thickness in the region outside the edge stiffening.

Furthermore, a panel weight ranging between 500 and 700 $g/m^2$, preferably approximately 600 $g/m^2$, have proved particularly energy efficient and at the same time sufficiently strong.

In a further preferred embodiment of the inventive flat speaker the panel is rectangular in shape. This is particularly favourable from the points of good space utilisation inside the cabin and of the radiation property, mode distribution and efficiency of the flat speaker.

According to a further preferred embodiment of the inventive flat speaker at least one of the covering layers comprises a composite fibre material, in particular a composite glass fibre material, and/or the core material comprises a honeycomb material, in particular of paper saturated in polyamide. These materials are particularly suitable because of their low weight and high strength, as well as their acoustic and airworthiness properties.

A cell width of the honeycomb material of between 2 and 4 mm is preferred, and in particular preference approximately 3.2 mm. The cell width is measured between two opposing walls of a cell of the honeycomb material. This embodiment has also proved in experiments both as energy efficient and sufficiently strong.

In a further preferred embodiment of the inventive flat speaker the edge stiffening comprises a composite fibre material and/or a metal and/or a plastic. The edge stiffening may therefore be of any design. A composite carbon fibre material may, in particular, also be considered as a composite fibre material.

According to a further preferred embodiment of the inventive vehicle the section of the cabin region is designed as an interior lining, preferably in a ceiling or wall region of the cabin region, as part of a passenger acoustic pipe and/or as part of a seat.

The invention is explained in further detail in the following on the basis of exemplary embodiments with reference to the attached figures.

DESCRIPTION OF EXEMPLARY EMBODIMENTS

In the figures the same reference symbols denote the same components or components with similar functions unless otherwise indicated.

Figure 1:
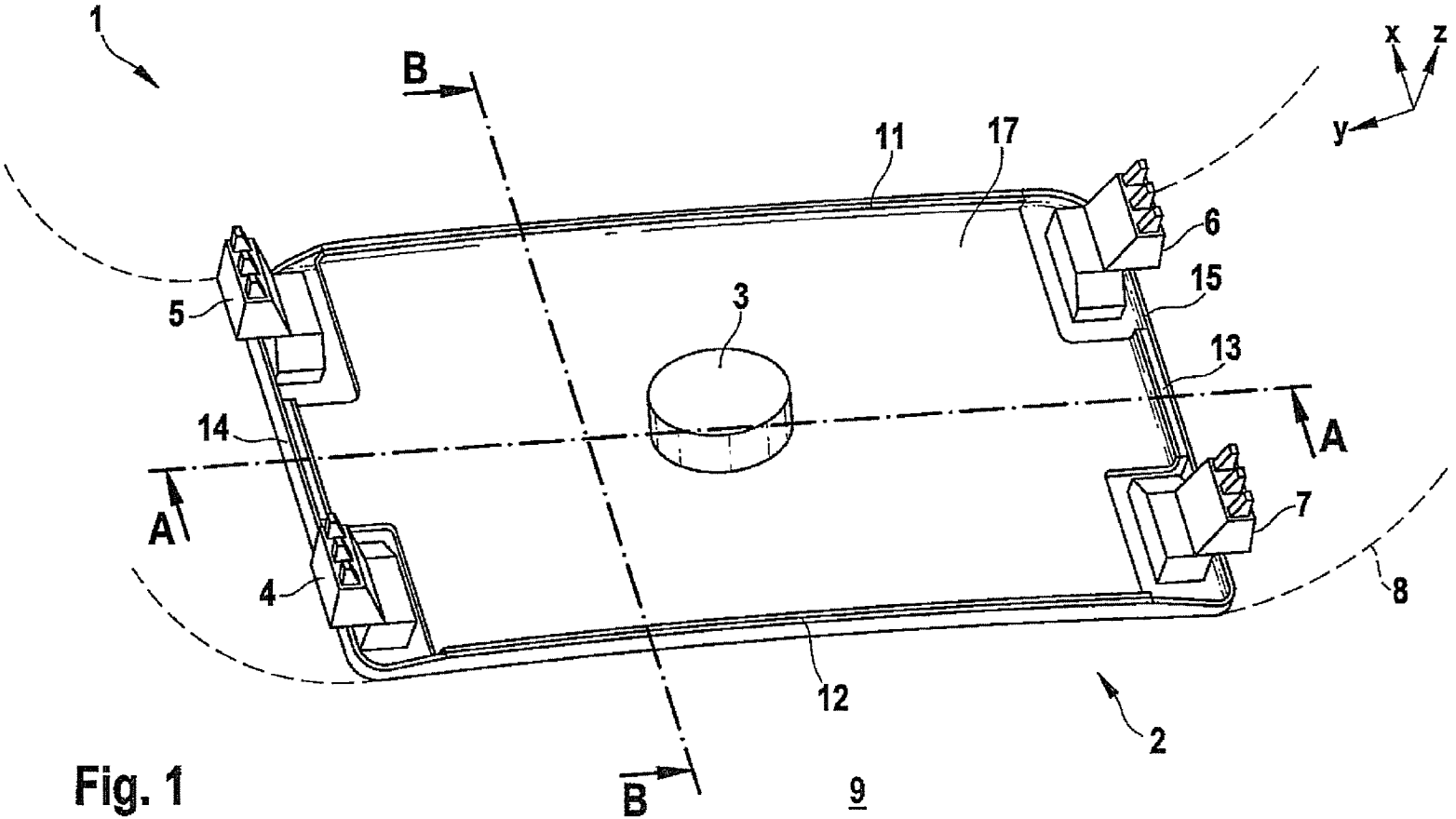
FIG. 1 shows in a perspective view a flat speaker according to an embodiment of the present invention.

FIG. 1 shows, in a perspective view, a flat speaker 1 according to an exemplary embodiment of this invention.

Flat speaker 1 has a preferably essentially rectangular panel 2 and a vibration exciter 3 arranged on it approximately centrally and connected to the panel. Vibration exciter 3 consists in this case of a magnet and a vibration coil, but here it only represented diagrammatically for the sake of clarity.

Preferably panel 2 is fastened by means of support elements 4, 5, 6, 7 in an acoustic pipe 8 of an aircraft above passengers 9, only roughly indicated.

In the position of installation of flat speaker 1 shown, the x-axis points in the longitudinal direction of the aircraft towards the nose, the y-direction points in the transverse direction of the aircraft, from right to left, and the z-direction points in the vertical direction of the aircraft.

Figure 2:
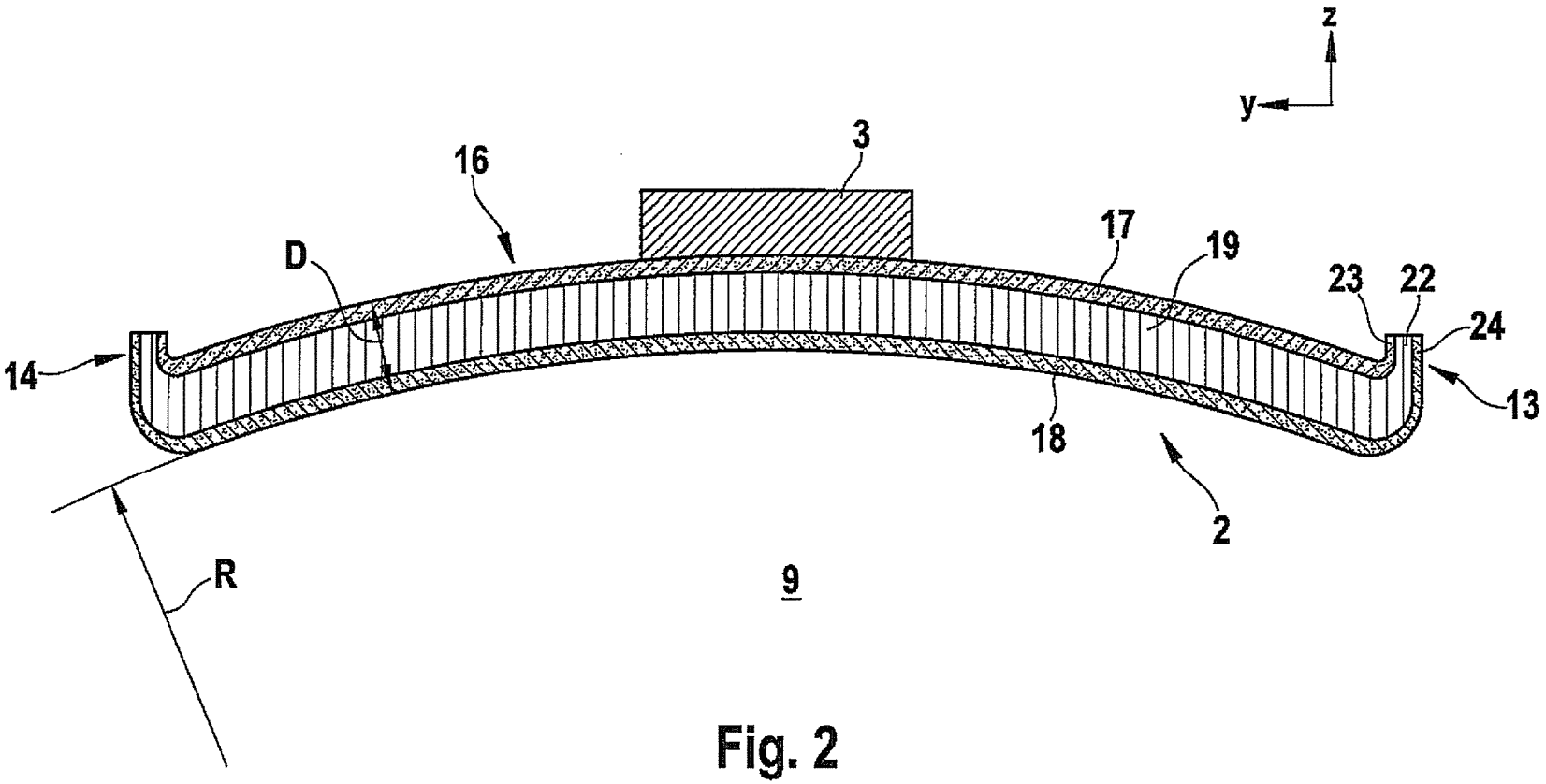
FIG. 2 shows a section A-A from FIG. 1.

Panel 2 extends superficially essentially in the x-y-plane and bends with a radius R, as shown in FIG. 2, in the y-z plane.

Panel 2 has edge stiffenings (provided, for example, with reference numbers 11, 12, 13, 14, 15) in order to resist forces, hand pressures, for example, introduced in particular in the z-direction.

An upward curving edge of upper covering layer 17 is defined with edge stiffening 15. This therefore also stiffens panel 2 since it also makes a not inconsiderable contribution to the moment of superficial inertia of panel 2 about the y-axis.

FIG. 2 shows a section A-A from FIG. 1.

Panel 2 has a sandwich material 16. Sandwich material 16 is composed of a lower covering layer 17, a lower covering layer 17, a lower covering layer 18 and a honeycomb material 19 arranged between them. Here the honeycombs of honeycomb material 19 extend essentially perpendicularly to panel plane x-y. Upper covering layer 17 and lower covering layer 18 are preferably produced from a composite glass fibre material and honeycomb material 19 is produced from a paper. Lower covering layer 18 faces towards the interior of the cabin, i.e. the passengers 9, in the installation position of flat speaker 1.

Upper covering layer 17 is preferably connected directly to vibration exciter 3.

Edge stiffenings 13, 14 are obtained in the exemplary embodiment according to FIG. 2 by applying the "crushed-core" technique to the ends of sandwich material 16. In this case the honeycomb material end 22 is first squeezed together with ends 23, 24 of upper and lower covering layers 17; 18 respectively, thereby compressing the intermediate honeycomb material end 22, and is then bent upwards, i.e. in the z-direction. The result is the condition shown in FIG. 2. Edge stiffening 14 is located on one end of panel 2 opposing edge stiffening 13 of panel 2, and is also produced according to the "crushed-core" technique.

Figure 3:
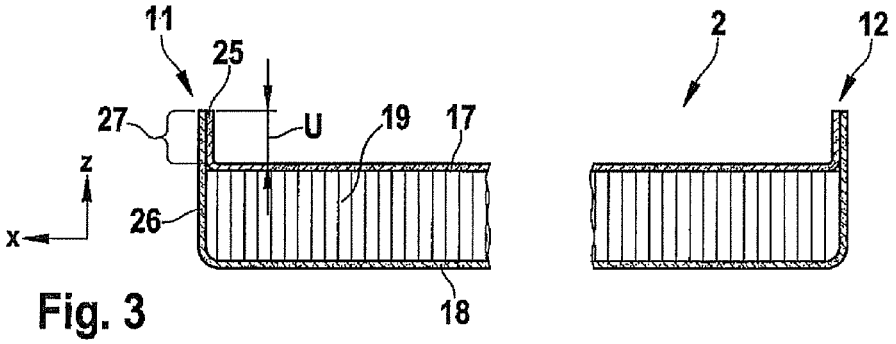
FIG. 3 shows a section B-B from FIG. 1.

FIG. 3 shows a section B-B from FIG. 1. Section B-B is represented in abbreviated form for the sake of clarity.

Edge reinforcements 11 and 12 formed together on ends of the panel opposing each other in the y-direction are produced similarly and the principle underlying this will be explained in the following on the basis of edge stiffening 11.

An end 25 of upper covering layer 17 projecting from honeycomb material 19 is bent upwards (i.e. in the z-direction). One end 26 of lower covering layer 18, projecting from honeycomb material 19, is then bent upwards (i.e. in the z-direction), so that end 26 is arranged with a section 27 overlapping end 25. End 26 is preferably glued fixedly to honeycomb core 19 and end 25 of upper covering layer 17 in the position shown in FIG. 3. Projection U of section 27 is in this case preferably approximately 3-10 mm.

It would be equally conceivable to bend end 25 downwards (i.e. against the z-direction), and bend end 26 of lower covering layer 18 upwards (i.e. in the z-direction), and then to glue them.

Figure 4:
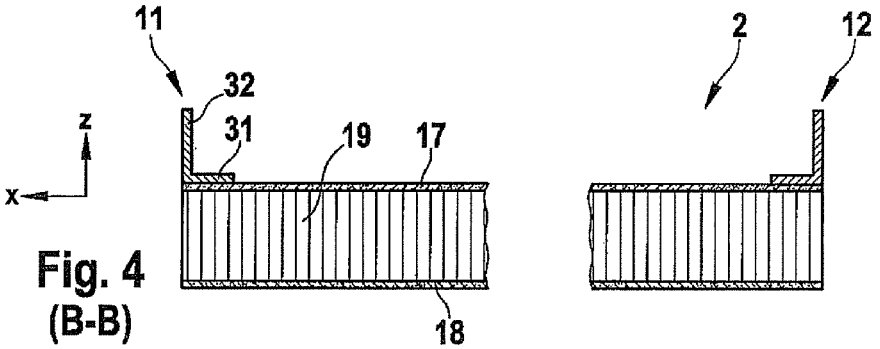
FIG. 4 shows section B-B from FIG. 1 according to a further embodiment of the present invention.

FIG. 4 shows section B-B from FIG. 1 according to a further exemplary embodiment of the invention.

Edge stiffenings 11 and 12 are constructed as separate components according to the exemplary embodiment according to FIG. 4. Edge stiffenings 11, 12 are constructed as L-shaped stiffening profiles extending in the y-direction and are glued to its one leg 31 on upper covering layer 17 (shown by way of example for edge stiffening 11), in particular also laminated onto it or laminated into it, the other leg 32 extending perpendicularly (i.e. in the z-direction) to the x-y-plane of panel 2.

Stiffening profiles may, for example, consist of plastic or also of metal. However, they are preferably produced from a composite fibre material.

Figure 5:
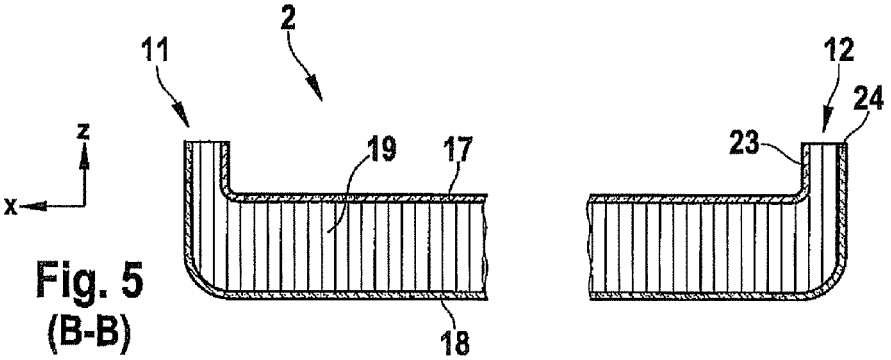
FIG. 5 shows section B-B from FIG. 1 according to yet a further exemplary embodiment of the present invention.

FIG. 5 shows section B-B from FIG. 1 according to yet a further exemplary embodiment of the invention. Here edge stiffenings 11, 12 are designed on the basis of the exemplary embodiment according to FIG. 2, similarly to edge stiffenings 13, 14, and are therefore not explained any further at this point.

Figure 6:
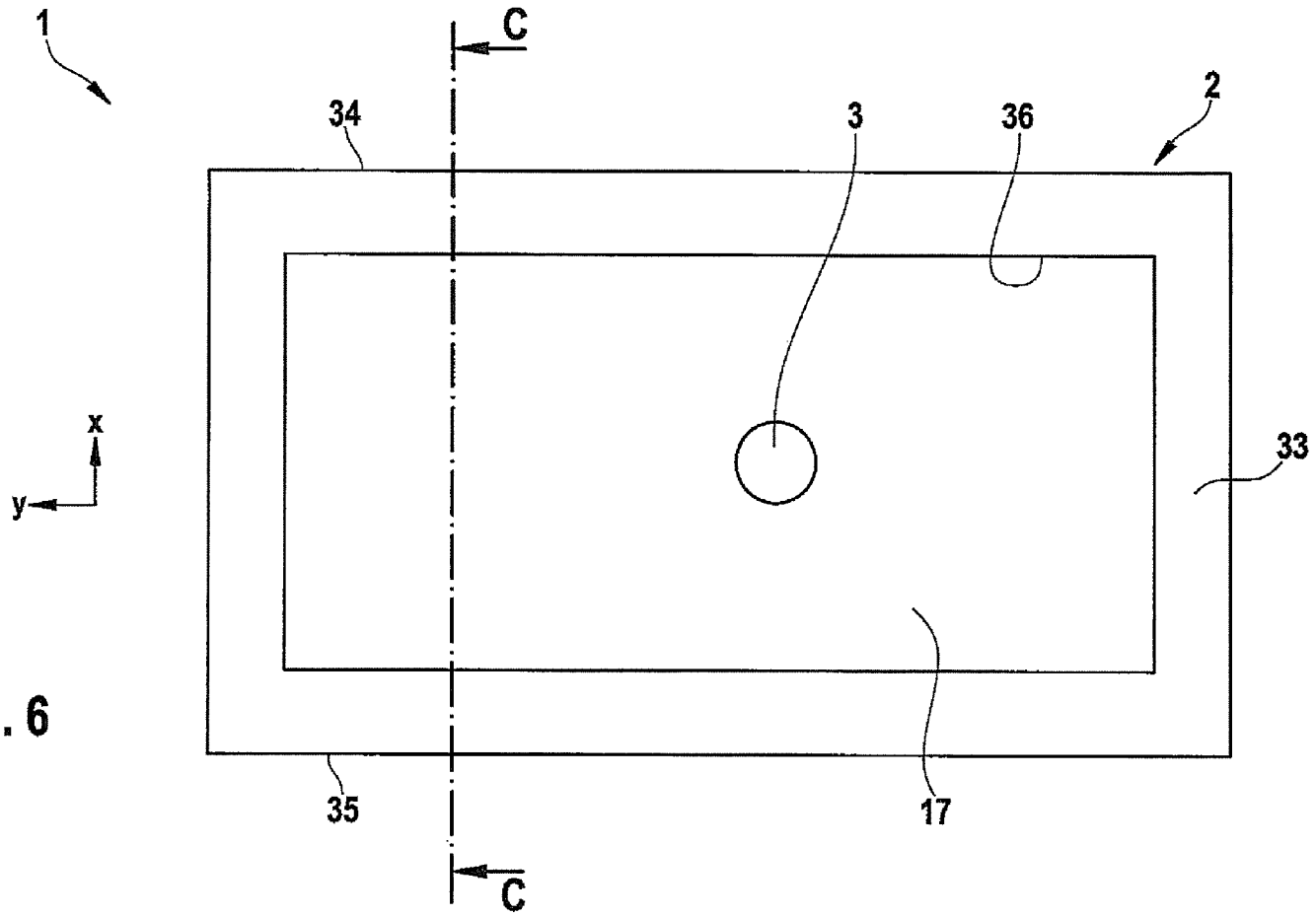
FIG. 6 shows in an elevation a flat speaker according to yet a further exemplary embodiment of the present invention.

FIG. 6 shows, in an elevation, a flat speaker 1 according to a further exemplary embodiment of this invention.

Panel 2 has an edge stiffening 33. Edge stiffening 33 is designed as an essentially rectangular strip adjacent to edges (designated by reference numbers 34, 35 by way of example) of panel 2. Here edge stiffening 33 has a preferably essentially rectangular recess 36.

Figure 7:
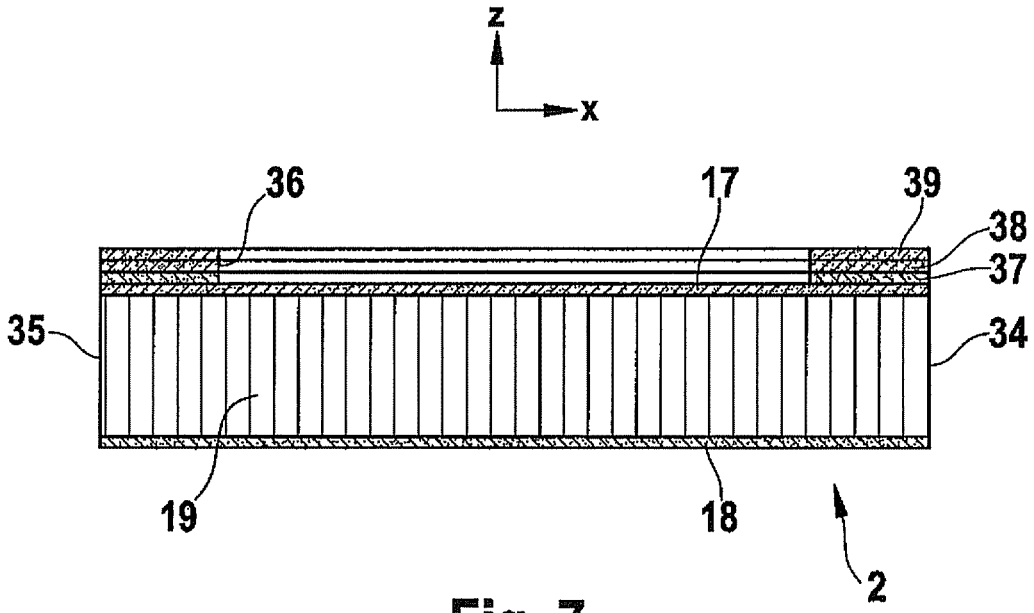
FIG. 7 shows a section C-C from FIG. 6.

As can be seen in FIG. 7, which shows a section C-C in FIG. 6, edge stiffening 33 is constructed of several layers 37, 38 and 39, for example a composite carbon material.

According to the exemplary embodiments according to FIGS. 1 to 6 panels 2 preferably have an area of approximately 600 $cm^2$, a thickness DS (see FIG. 2) of approximately 6 mm and a weight of approximately 600 $g/m^2$. The cell width of honeycomb material 19 is preferably 3.2 mm.

Although this invention has here been described on the basis of preferred exemplary embodiments, it is not restricted to them but can be modified by any means.

The different embodiments of edge stiffenings described here may, for example, be combined in any manner. For example, one end of the panel may be designed according to the "crushed-core" technique and another end may have an edge stiffening in the form of a stiffening profile.

LIST OF REFERENCE NUMERALS

1 Flat speaker
2 Panel
3 Vibration exciter
4 Supporting element
5 Supporting element
6 Supporting element
7 Supporting element
8 Passenger acoustic pipe
9 Passengers
11 Edge stiffening
12 Edge stiffening
13 Edge stiffening
14 Edge stiffening
15 Edge stiffening
16 Sandwich material
17 Upper covering layer
18 Lower covering layer
19 Honeycomb material
22 Honeycomb material end
23 End
24 End
25 End
26 End
27 Section
31 Leg
32 Leg
33 Edge stiffening
34 Edge
35 Edge
36 Recess
37 Layer
38 Layer
39 Layer
x Spatial direction
y Spatial direction
z Spatial direction
R Radius
D Thickness
U Projection

The invention claimed is:

1. A flat speaker in the aerospace sector, comprising:

a panel for generating acoustic signals by means of vibration of the same; and a vibration exciter centrally connected to the panel and capable of exciting the panel to vibrate;

wherein said panel has a weight ranging between 500 and 700 $g/m^2$ and a panel thickness of between 4 and 8 mm, wherein the panel comprises a sandwich material having at least one upper covering layer, at least one lower covering layer, and a core material arranged between the upper and lower covering layers;

wherein said at least one upper covering layer, said at least one lower covering layers, and said core material are bent at common ends from a plane of the panel to form at least one edge stiffening element; and wherein said at least one edge stiffening element is configured for preventing damage to the panel by passengers.

2. The flat speaker according to claim 1, wherein the respective ends of the upper and lower covering layer are bent out of the plane in the same direction, wherein they overlap each other in a section.

3. The flat speaker according to claim 1, wherein at least one of the upper covering layer or the lower covering layer comprises at least one recessed region, and wherein the at least one recessed region is rectangular.

4. The flat speaker according to claim 1, wherein at least one of the panel, and the edge stiffening element has a shape curved in at least one plane.

5. The flat speaker according to claim 1, wherein the panel has an area of 600 $cm^2$, and wherein the thickness of the panel is 6 mm.

6. The flat speaker according to claim 1, wherein the panel comprises a rectangular shape.

7. The flat speaker according to claim 1, wherein at least one of the covering layers comprises a composite fibre material, and the core material comprises a honeycomb material made of paper, and wherein a cell width of the honeycomb material is between 2 and 4 mm.

8. A vehicle, in particular an aircraft or space vehicle, comprising:

a cabin region for passengers, pilots and/or co-pilots; and at least one flat speaker according to claim 1 for an acoustic system for the passengers, pilots and/or co-pilots, wherein the panel of the flat speaker forms one section of the cabin region itself.

9. The vehicle according to claim 8, wherein the section of the cabin region is designed as an interior lining, preferably in a ceiling or wall region of the cabin region to the panel of the flat speaker, as part of a passenger acoustic channel and as part of a seat.

10. A method of providing the flat speaker according to claim 1, comprising:

arranging the panel by sandwiching the core material between said lower covering layer and said upper covering layer;

forming a crushed-core-edge by squeezing at least one end of the core material against at least one end of said upper covering layer and one end of said lower covering layer as said crushed-core-edge; and bending said crushed-core-edge out of the plane of the at least one of said lower covering layer and said upper covering layer to form said edge stiffening.

* * * * *